US005835027A

United States Patent [19]

Tyburski et al.

[11] Patent Number: 5,835,027

[45] Date of Patent: Nov. 10, 1998

[54] RESIDUAL CHARGE EFFECT TRAFFIC SENSOR

[76] Inventors: Robert M. Tyburski, P.O. Box 244, Lottsburg, Va. 22511; Robert W. Shillady, 1398 Uxbridge Way, North Whales, Pa. 19454

[21] Appl. No.: 745,120

[22] Filed: Nov. 7, 1996

[51] Int. Cl.[6] ..... G08G 1/01

[52] U.S. Cl. ..... 340/933; 340/941; 200/86 A; 364/436

[58] Field of Search ..... 340/933, 941, 340/935, 936, 939; 200/85 R, 86 A, 86 R; 324/236, 238, 244, 654, 655; 364/436, 438, 565; 73/866.5

[56] References Cited

U.S. PATENT DOCUMENTS

| | | | |
|---|---|---|---|
| 2,740,184 | 4/1956 | Thomas . | |
| 3,632,443 | 1/1972 | Kodero et al. . | |
| 3,652,932 | 3/1972 | Sessler et al. . | |
| 3,668,417 | 6/1972 | Sessler et al. . | |
| 3,736,436 | 5/1973 | Crites . | |
| 3,750,149 | 7/1973 | Sessler et al. . | |
| 3,763,482 | 10/1973 | Burney et al. . | |
| 3,809,828 | 5/1974 | Haugsjaa et al. . | |
| 3,906,492 | 9/1975 | Narbaits-Jaureguy et al. | 340/933 |
| 3,911,390 | 10/1975 | Myers . | |
| 3,940,974 | 3/1976 | Taylor . | |
| 4,040,044 | 8/1977 | Laymon et al. . | |
| 4,183,010 | 1/1980 | Miller . | |
| 4,250,415 | 2/1981 | Lewiner et al. . | |
| 4,374,299 | 2/1983 | Kincaid | 340/933 |
| 4,383,239 | 5/1983 | Robert | 340/933 |
| 4,390,800 | 6/1983 | Tanaka et al. . | |
| 4,400,634 | 8/1983 | Micheron . | |
| 4,441,038 | 4/1984 | Tanaka et al. . | |
| 4,443,711 | 4/1984 | Tanaka et al. . | |
| 4,495,541 | 1/1985 | Magee et al. . | |
| 4,612,145 | 9/1986 | Keith et al. . | |
| 4,794,365 | 12/1988 | Dunbar . | |
| 5,008,666 | 4/1991 | Gebert et al. | 340/933 |
| 5,115,109 | 5/1992 | Fisher | 340/933 |
| 5,196,846 | 3/1993 | Brockelsby et al. | 340/933 |
| 5,206,642 | 4/1993 | Gregoire et al. | 340/933 |
| 5,245,334 | 9/1993 | Gebert et al. | 340/933 |
| 5,267,076 | 11/1993 | Broussoux et al. . | |
| 5,448,232 | 9/1995 | Tyburski . | |
| 5,450,077 | 9/1995 | Tyburski . | |
| 5,463,385 | 10/1995 | Tyburski | 340/933 |
| 5,477,217 | 12/1995 | Bergan | 340/933 |
| 5,486,820 | 1/1996 | Chatigny et al. . | |
| 5,554,907 | 9/1996 | Dixon | 340/933 |
| 5,668,540 | 9/1997 | Bailleul et al. | 340/933 |

*Primary Examiner*—Nina Tong
*Attorney, Agent, or Firm*—Kerkam, Stowell, Kondracki & Clarke, P.C.; Edward J. Kondracki

[57] ABSTRACT

The naturally occurring residual charge of a dielectric is utilized to establish a static electric field adapted to be disturbed by a conductive member upon occurrence of an event, such as, for example, the passage of a vehicle tire over the conductive member. Disturbance of the electric field results in the generation of a pulse that can be monitored. A traffic sensor for monitoring the number and speed of vehicles traveling in multiple lanes of a roadway employing dielectrics with naturally occurring residual charge includes a housing containing a cavity, a conductive mounting bar adapted to fit within the cavity, at least two sensing elements including the dielectrics mounted on the mounting bar so as to generate a signal when impacted by a vehicle tire. A transmission cable connects with the sensing elements for transmitting the electric signals generated by the sensing elements to analyzing equipment for evaluating, displaying, and recording the data generated by the sensing elements. Signals are transmitted through every other wire of the transmission cable to minimize cross-talk between the signal carrying wires.

13 Claims, 7 Drawing Sheets

RESIDUAL CHARGE EFFECT TRAFFIC SENSOR

BACKGROUND OF THE INVENTION

The present invention relates to sensors and, more particularly, to a traffic sensor which senses the impact of a vehicle tire.

Traffic management has become an important issue as a result of the increasing numbers of vehicles on the roads and the limited roadways available to handle the traffic. In order to manage traffic, both short and long term traffic volume of all major arteries in congested regions must be known. When this data is available, traffic engineers can provide solutions by redirecting traffic and/or by expanding the roadway system.

The present invention utilizes the residual charge present in certain materials as the energy source for a sensor. Study of the residual charge effect has led to the use of this technology for the present invention. An understanding of the effect has also led to the design of a transmission cable for transmitting the sensed signals to recording equipment without corruption by cross-talk from neighboring sensors.

Evidence of a permanent residual charge has been observed in many insulating and semi-insulating materials, a result of the manufacturing process. This residual charge is employed in the present invention to generate a static electric field. Generation of the electric field is achieved with a first electrode, a first dielectric in intimate contact with the first electrode, and a second electrode separated from the first dielectric with a second dielectric. The electric field, combined with a mechanical force supplied by an object striking the sensor, such as a tire, generates a signal pulse.

The residual charge effect employed herein is separate and distinct from either ferroelectric or electret materials, wherein the molecular structure of the dielectric material is oriented in such a way as to effect polarization of the material. The present invention, by contrast, makes use of common materials and does not alter the molecular properties of the dielectric.

BRIEF DESCRIPTION OF THE PRIOR ART

Various devices for measuring the number of vehicles traveling on a roadway are known in the patented prior art. The Myers U.S. Pat. No. 3,911,390, for example, discloses a traffic sensor for monitoring traffic moving in a plurality of different lanes of a roadway. In one embodiment of the invention, a sensor segment is enclosed in a sealed polyethylene housing. The sensor segment includes a resilient envelope in which are mounted a pair of parallel spaced conducting plates held in position by a pair of compressible spacers. When the envelope is compressed, the plates contact each other. The plates are connected with an assembly for sensing and recording contact between the plates. In an alternate embodiment, a coaxial cable having a central conductor surrounded by dielectric insulation is used in place of the sensor segment.

The Tyburski U.S. Pat. Nos. 5,448,232 and 5,450,077 disclose piezoelectric roadway sensors having linear weight means distributed along the sensor sufficient to maintain the sensor on the road.

An ideal traffic sensor is inexpensive to produce, portable, easily deployed, usable for multiple lane applications, has a low profile, a long life, a high signal to noise ratio, is capable of high speed measurements, and is usable in hostile road environments. The prior traffic sensors do not satisfy one or more of the above characteristics rendering them unsatisfactory for traffic management applications. The present invention was developed to overcome these and other drawbacks of the prior sensors by providing a roadway traffic sensor which in its basic configuration includes two electrodes separated by two dielectrics, one of the dielectrics being air. In an alternate configuration, the signals produced by the sensor are transmitted through every other wire of a ribbon cable, with the non-signal carrying wires being grounded. In this manner, unwanted cross-talk is minimized, thereby producing a high signal to noise ratio.

SUMMARY OF THE INVENTION

Accordingly, a primary object of the present invention is to provide an improved traffic sensor which is inexpensive to produce, durable, accurate, portable, easily deployed, and which can be used to monitor multiple lanes of traffic.

It is a more specific object of the invention to provide a traffic sensor including a housing containing a cavity, a conductive mounting bar adapted to fit in the cavity, at least two sensing elements mounted on the mounting bar which generate signals when impacted by a vehicle, a transmission cable connected with the sensing elements for transmitting the electric signals generated by the sensing elements, and analyzing equipment for evaluating, displaying, and recording the data generated by the sensing elements.

The sensor is characterized by a first electrode or conductor, a first dielectric in intimate contact with the first electrode which carries a residual charge that migrates to the first electrode/first dielectric interface when placed in intimate contact therewith, a second dielectric arranged adjacent the first dielectric, and a second electrode or conductor arranged adjacent the second dielectric. The first electrode and dielectric may be, for example, an ordinary insulated electrical wire such as a wire coated with a synthetic resin polymer (Teflon) and the second dielectric may be an air gap which surrounds the wire. Certain paper materials exhibiting a negligible residual charge may also be used as one of the dielectrics. In addition, a ferroelectric or electret polymer material known as KYNAR when metalized on one side may be used as one of the dielectrics. When metalized on one side, KYNAR produces the same behavior as the sensor of the present invention but has increased sensitivity.

It is another object of the invention to provide a multi-lane traffic sensor which minimizes cross-talk between the wires of the transmission cable by grounding every other wire of the transmission cable.

It is a further object of the present invention to provide a multi-lane traffic sensor having an access opening in the housing, thereby affording easy access to the components contained in the housing.

It is yet another object of the invention to provide a multi-lane traffic sensor that has a low profile and can be either mounted on the surface of the roadway or embedded within the roadway.

It is a further object of the present invention to provide a traffic sensor which can be used with existing traffic analyzing equipment.

BRIEF DESCRIPTION OF THE DRAWINGS

Other objects and advantages of the invention will become apparent from a study of the following specification when viewed in light of the accompanying drawings, in which.

DETAILED DESCRIPTION

Figure 1:
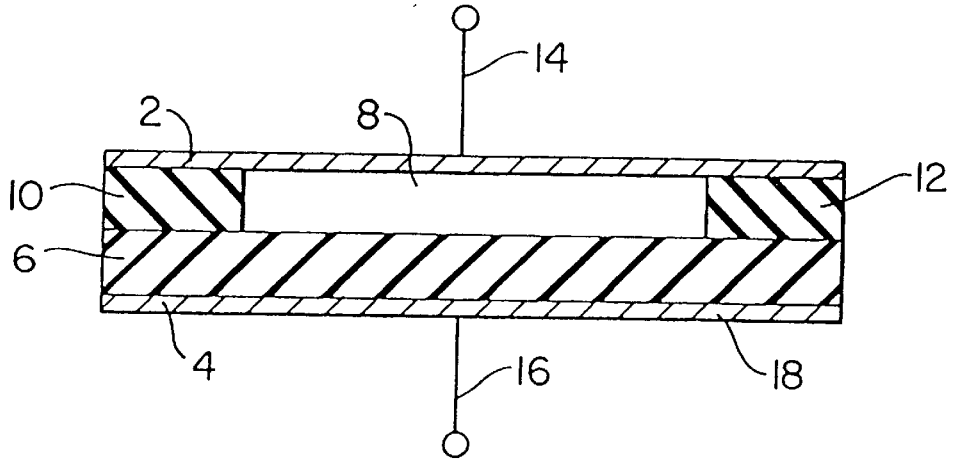
FIG. 1 is a cross-sectional view of the basic sensor according to the invention.

A substance, whether a conductor or an insulator, comprises positive atomic nuclei surrounded by negative electron clouds. Bodies are electrified by the transfer of electrons from one body to another. The common methods of electrifying a body include rubbing (tribo) or, in the case of a conductor, by momentary contact with an electric source. Two charged bodies exert a force on one another, the amount of force being a measure of the charge. The clinging of polyethylene food wraps is one example of the existence of such a residual charge.

All insulators, with the exception of a total vacuum, are dielectric materials. Residual charge, utilized in the present invention, is generated in the manufacturing process of certain materials and remains on certain materials indefinitely. Experimentation conducted during the development of the present invention led to the conclusion that few insulators are truly charge neutral. Some materials, however, possess considerably more residual charge than others. The present invention uses this potential energy source to produce a low cost sensor design.

The various dielectrics possessing residual charge have been determined not to be polarized. If, however, the material is placed in intimate contact with a conductor, at least some of the residual charge migrates to the conductor-dielectric interface and space charge or interfacial polarization results. The conductor acts as one electrode of the sensor in the present invention. The second electrode, therefore, must be configured to move through the field and/or modify the field set up by the dielectric so as to produce a signal as will be described more fully below.

Some known sensors employ electrets which are a subset of ferroelectric materials. Ferroelectric materials exhibit an electric dipole moment or polarization in the absence of an electric field. These materials are generally crystalline in nature. Piezoelectric materials and electrets are included under this general category. The electric dipole moment can be altered in piezoelectrics by mechanically modifying their atomic structure. Some polymers have been developed which, after exposure to very intense electric fields, fall into the piezoelectric category. These polymers are generally classified as electrets after the treatment.

The present invention functions in a manner similar to that of known sensors. The present invention, however, adds new features that solve several of the operational problems that have plagued the traffic data collection industry for many years. The solution of these problems rests in the use of a technology which heretofore has not been employed although manifestations thereof are a common occurrence, namely, static charge. It is not widely recognized that minute levels of residual charge are retained in most dielectrics indefinitely. Furthermore, it is not widely recognized that when dielectrics are placed in intimate contact with a conductor, interfacial polarization develops at the junction of the two materials. When another conductor and a dielectric, such as air, are introduced, a useful static electric field develops. These materials form a sensor element capable of detecting mechanical motion. Solids (e.g. axle sensors), liquids (e.g. hydrophones) or gases (e.g. microphones) can be used to excite the sensor. The subject of this invention, however, is a sensor which senses the impact of a vehicle tire(s).

In the electrification of a body, equal amounts of charge of opposite polarity form on the body. The conservation law for electric charge states that the total charge in a closed system remains constant. Charge can be neither created nor destroyed, only shifted from one body to another. If a body becomes electrified, it attempts to neutralize itself by seeking another body in a similar condition but of opposite polarity. The bodies dealt with in this process are either conductors or insulators, but the two are at times not easy to distinguish from one another. When an object is introduced into an electrostatic field, a field develops within the object. The development of the field has an electric current associated with the process. The current tends to produce a surface charge on the object and the charge is compensated (a null condition) within the remainder of the body. If the body is a conductor, the excess charge travels to its surface quickly (i.e. in less than $10^{-6}$ seconds). If the body is a dielectric, the excess charge may take an infinite duration to reach the surface. Of interest to the present invention is when an object is found to have an excess of either positive or negative charge. For the most part, the materials investigated are considered insulators according to the above definitions but some fall within the gray area which lies between the two extremes (insulators-conductors). The following discussion focuses on perfect insulators and conductors.

With the exception of a vacuum, insulators are dielectrics, some of which are more useful than others. In order to make use of the insulator's residual charge as a predictable energy source, the charge must create a defined electric field. The electric field can then be embodied in a sensor that generates a signal which is both measurable and predictable. Since the residual static charge is stored in a dielectric, polarization of the dielectric is a key factor in this process. The measure of a given material's ability to be polarized is noted by its permittivity or dielectric constant. The effect of introducing a dielectric between the two plates of a capacitor is well known, e.g. the ability of a capacitor to store energy is increased by a factor equal to the dielectric's relative permittivity. The applied electric field reorients the dipoles within the dielectric and serves as the energy storage mechanism. A few common insulators along with their relative dielectric constants are listed in Table 1:

TABLE 1

| Insulator with Dielectric Constants | |
|---|---|
| Air | 1.0005 |
| Petroleum | 2.1 |
| Polymers | 2 to 6 |
| Glass | 5 to 8 |
| Porcelain | 6 |
| Alcohol | 26 |
| Water | 81 |

The ability of a given dielectric to take on and retain residual charge does not appear to be related solely to its permittivity. Prior studies have been conducted relative to the triboelectric effect which included various material's susceptibility to take on residual charge. These results are published in MILHDBK-263A, page 19. The data are given in Table 2 as presented in the referenced document.

TABLE 2

| Sample Triboelectric Series | |
|---|---|
| Positive (+) | Human Hands |
| | Rabbit Fur |
| | Glass |
| | Mica |
| | Human Hair |
| | Nylon |
| | Wool |
| | Fur |
| | Lead |
| | Silk |
| | Aluminum |
| | Paper |
| | Cotton |
| | Steel |
| | Wood |
| | Amber |
| | Sealing Wax |
| | Hard Rubber |
| | Nickel, Copper |
| | Brass, Silver |
| | Gold, Platinum |
| | Sulfur |
| | Acetate Rayon |
| | Polyester |
| | Celluloid |
| | Polyurethane |
| | Polyethylene |
| | Polypropylene |
| | PVC |
| | KEL |
| | Silicon |
| Negative (−) | TEFLON |

The publisher qualified the data stating that the precise order of the materials in a triboelectric series is dependent upon many variable factors and that a given series may not be repeatable.

Experimentation conducted during the development of the present invention, on the materials noted above, shows a correlation between the rating of the triboelectric series in Table 2 and the amount of residual charge observed on these materials. Of the materials studied during this development, Teflon was determined to contain the highest levels of residual charge.

There are four known mechanisms of polarization. They are: (1) electronic polarization, (2) atomic polarization, (3) orientation polarization, and (4) space charge polarization. The first three mechanisms are due to charges that are locally bound in atoms, in molecules, or in the structures of solids or liquids. Relative to the fourth mechanism, charge carriers may exist that can migrate for some distance through the dielectric. These carriers can become trapped in the material, on an interface, or because they cannot be freely discharged at the electrodes. This condition is known as space charge polarization. Space charge polarization or, more specifically interfacial polarization, is utilized in the present invention. The polarization property is an important aspect of the present invention because it orients the electric field which, in turn, produces the sensor's output signal when another conductor is moved through the field in a specified manner.

Development of the fundamental theory behind the sensor's operation is beyond the scope of this description. A few reasonably well recognized relationships, however, are presented to illustrate the basic operation of the sensor. In the analysis, vector quantities are designated with bold face type.

Referring to FIG. 1, there is shown a basic configuration of the sensor of the present invention. The sensor includes a pair of elongated metallic plates 2 and 4 separated by a dielectric slab 6 and an air gap 8 formed by a pair of elastic supports 10 and 12. Alternatively, the air gap 8 may be replaced with a compressible dielectric material having a different dielectric constant than that of the slab 6 to effect the same results. A pair of contacts or terminals 14 and 16 are connected with plates 2 and 4, respectively. Dielectric slab 6 is in intimate contact with metal plate 4, thereby forming an interface at 18. Some of the residual charge in the dielectric drifts to the metal/dielectric interface 18 resulting in the interfacial polarization discussed above. As a result of the polarization, an electric field establishes itself between the two plates. By definition, all conductors have charges free to move about on their surface. If the plate 2 is moved relative to plate 4, charge Q is moved through the field. Work is required to move a charge Q through an electric field. The force, F, on Q due to the electric field, E, is $$F=Q\,E \tag{1}$$

The magnitude of the work, W, is defined by the integral in (2) where L is the distance moved $$W=-Q\int_{initial}^{final} E\bullet dL \text{ joules} \tag{2}$$

The potential difference, V, is defined as the work done in moving the unit positive charge from one point to another in an electric field. The voltage developed in moving the unit charge from B to A is given by the integral equation $$V_{AB}=-\int_B^A E\bullet dL \text{ volts} \tag{3}$$

These relationships are general and can be utilized to analyze any given sensor configuration.

At least three separate basic field configurations could be used to realize the electric field within a given sensor. First, the electric field generated by a point charge falls in intensity at a rate inversely related to the square of the distance from the point charge. In addition, it is subject to the permittivity of the media in which it is embedded. Second, the electric field generated by a line charge falls at a rate inversely related to the distance from the charged line and is again subject to the permittivity. Third, the electric field generated by an infinite sheet of charge is constant and independent of the distance from the charged surface. The flux density D behaves in the same manner but is not subject to the permittivity of the dielectric. Although any of these configurations, or variations thereof, could be used for the sensor element, the latter two appear to be most appropriate for the application at hand.

Figure 2A:
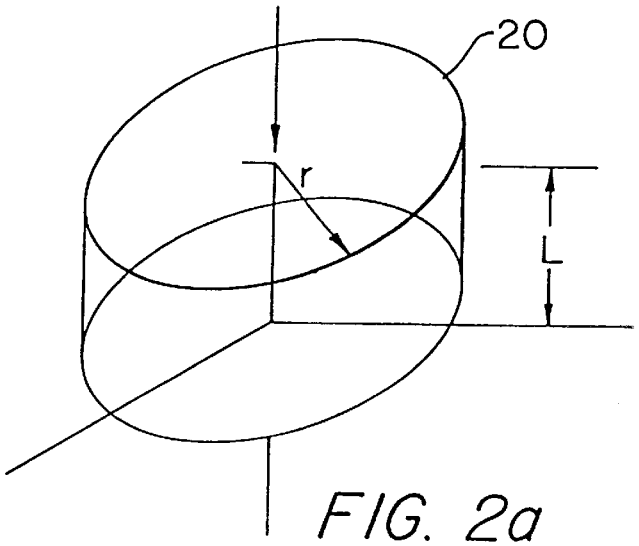
FIG. 2*a* is a graphical representation of a Gaussian surface for a right circular cylinder.

FIG. 2*a* shows a Gaussian surface 20 for an infinite line charge in the form of a right circular cylinder of length L and radius r. Gauss's law is given by the expression $$Q = \oint_{cyl} D_s \cdot dS. \tag{4}$$

where

Q≡total enclosed charge.

$D_s$≡surface flux density

S≡surface area

If the charge distribution is known, the flux density can be determined from the above expression. A coordinate system is chosen for this analysis to obtain a closed surface which satisfies two conditions:

1. $D_s$ is everywhere either normal or tangential to the closed surface so that $D_s \bullet dS$ becomes either $D_s$ dS or zero, respectively.
2. On the portion of the closed surface integral for which $D_s \bullet dS$ is not zero, $D_s$ is constant.

The coordinate system is chosen knowing that the electric field intensity due to positive point charge is directed radially outward from the point charge.

Figure 2B:
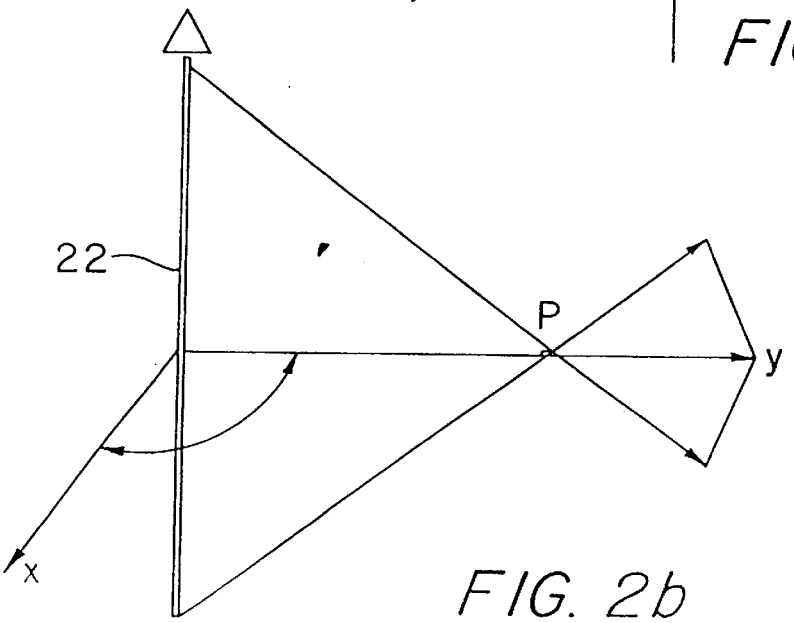
FIG. 2*b* is a graphical representation of an infinite line charge for a right circular cylinder.

An infinite line of charge 22 is chosen for the analysis as shown in FIG. 2*b*. In the cylindrical configuration chosen, all of the field components on the z axis cancel because equal and opposite components exist all along the line from other elements. Since charge radiates equally in all directions, inspection shows that D is not a function of either z or $\phi$, only a function of r. The symbol $\phi$ represents the radial angle about the coax. Hence, only the $D_r$ component is present in the field.

The closed right circular cylinder of FIG. 2*a* of radius r, extending from z=0 to z=L, is chosen to apply Gauss's law.

$$Q=D_s\int_{r=0}^{L}\int_{\phi=0}^{2\pi} \rho_s\, rd\phi dz=D_s 2\pi rL \tag{5}$$

$$D_s=D_r=Q/2\pi rL \tag{6}$$

In the above expression $\rho_s$ is used to label the surface charge density on the line. The term $\rho_L$, is used to designate the surface charge density per unit length. The total charge enclosed Q is then $$Q=\rho_L L \tag{7}$$

producing $$D_r=\rho_L/2\pi r \tag{8}$$

since $$E=D/\epsilon \tag{9}$$

and $$E_r=\rho_L/2\pi\epsilon r. \tag{10}$$

Figure 3:
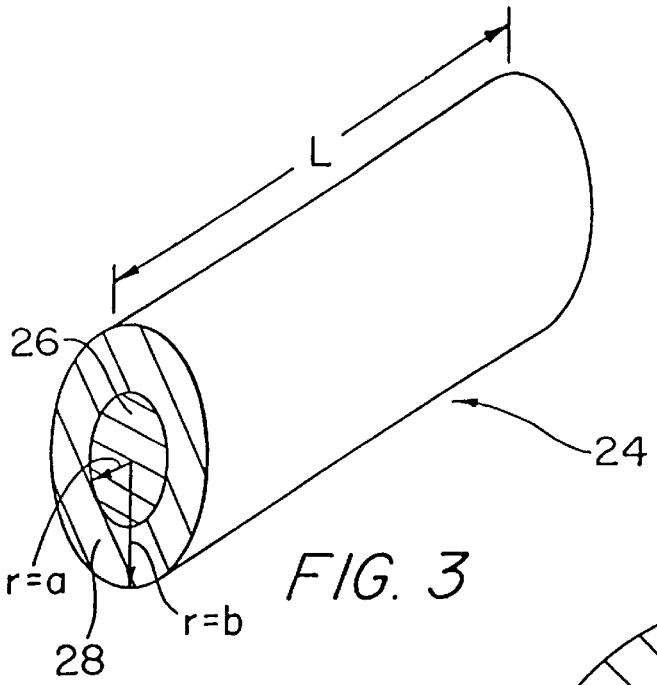
FIG. 3 is a schematic of a coaxial capacitor.

Analysis of a coaxial sensor or capacitor is nearly identical to that of a line charge. FIG. 3 shows a coaxial capacitor 24 formed from an inner coaxial cylindrical conductor 26 having a radius a, and an outer coaxial cylindrical conductor 28 having a radius b. Symmetry considerations dictate that only the $D_r$ component is present and is a function of the radius, r. Right circular cylinder 28 of length L and radius r, where a<r<b, is necessarily chosen as the Gaussian surface. The total charge on a length L of the inner conductor is $$Q=\int_{z=o}^{L}\int_{\phi=0}^{2\pi} \rho_s a d\phi dz=2\pi a\ L\ \rho_s \tag{11}$$

Combining equations 6 and 11 yields $$D_s=a\rho_s/r \text{ or } D=(a\rho_s/r)a_r \tag{12}$$

for a<r<b. The latter expression shows that the electric flux is directed outwardly from the center of the structure and is a function only of the radius r. Alternately, the coaxial line can be expressed in terms of charge per unit length because the inner conductor has $2\pi a\rho_s$ coulombs on a meter length. Letting $\rho_L=2\pi a\rho_s$, $$D=(\rho_L/2\pi r)a_r \tag{13}$$

Equation 13 shows that the solution has a form identical to that of an infinite line charge.

Since every line of electric flux emanating from charge on the inner cylinder must terminate on a negative charge on the inner surface of the outer cylinder, the total charge on that surface must be $$Q_{outer\ cyl}=-2\pi aL\rho_{s(inner\ cyl)} \tag{14}$$

The surface charge on the outer cylinder is found as $$\rho_{s(outer)}=-a\rho_{s(inner)}/b \tag{15}$$

Figure 4A:
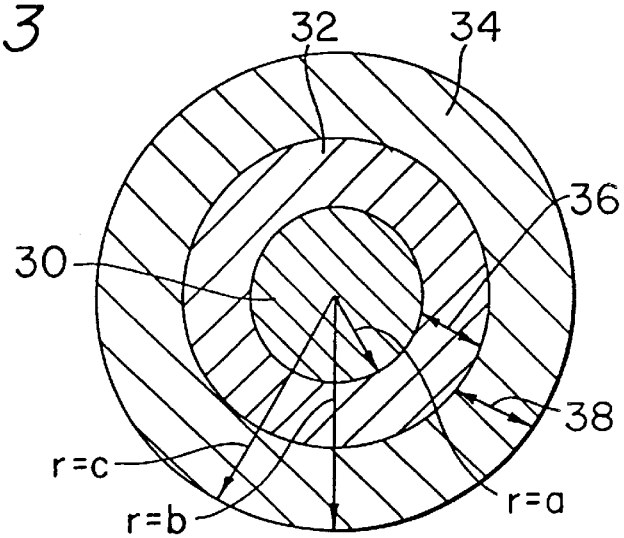
FIG. 4*a* is a cross-sectional view of a coaxial sensor.

FIG. 4*a* shows the cross-sectional details of a coaxial line sensor having an inner conductor 30, a dielectric 32 arranged concentrically around the inner conductor, and an outer conductor 34 arranged concentrically around the dielectric. Although the sensor design may vary, the configuration of FIG. 4*a* closely approximates that of a common arrangement. The choice of the two cylindrical conductors 30 and 34 greatly simplifies the analysis. The volume from r=a to r=b indicated by reference numeral 36 has a permittivity of $\epsilon_1$; from r=b to r=c indicated by reference numeral 38 the permittivity is $\epsilon_2$. A charge of $2\pi a\rho_s$ coulombs/meter is retained on the surface of the inner conductor. The following facts are evident based on the discussion above:

1. D varies only with r;
2. only the $D_r$ component is present as in the previous discussion; and
3. the same cylinder may be used as the closed surface.

The presence of the dielectric does not affect the solution insofar as the flux density D is concerned. The electric field, however, is a function of both the permittivity and the flux density where D=$\epsilon$E. If Equation 13 is expressed as the electric field, it takes on the following form $$E_r=\rho_L/2\pi\epsilon r. \tag{16}$$

The electric field in the region a<r<c, since $\epsilon=\epsilon_1$, is expressed as $$E_r=\rho_L/2\pi\epsilon_1 r \tag{17}$$

Likewise, the region from c<r<b is expressed as $$E_r=\rho_L/2\pi\epsilon_2 r \tag{18}$$

Two different expressions exist to represent the electric field between the two conductors, each valid only in a restricted range.

Figure 4B:
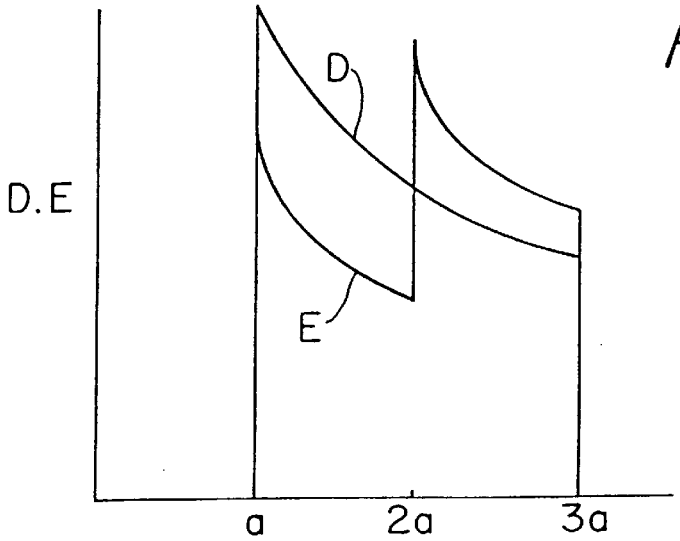
FIG. 4*b* is a graphical representation of the flux density and electric field for the coaxial sensor of FIG. 4*a;*

The variation of the flux density D and the electric field E is presented graphically in FIG. 4*b* for the permittivity ratio $\epsilon_1/\epsilon_2=2$ which corresponds to the ratio of Teflon to air. Note that $D_r$ is continuous but $E_r$ has a discontinuity at the interface of the two dielectrics increasing by the factor $\epsilon_1/\epsilon_2$.

The sensor output is the potential developed between the two conductive elements when force is applied. Potential difference, V, is defined as the work done by an external source in moving a unit positive charge from one point to another within an electric field and is measured in joules per coulomb. The relationship is expressed mathematically as $$V_{AB}=\int_A^B E\bullet dL \text{ volts} \tag{19}$$

Work is performed when the sensor is actuated by moving a conductor. The unbound charge on the conductor is moved through the electric field. The magnitude of the developed voltage represents the work done in moving the charge from the initial position to the maximum point of deflection. The voltage developed at the sensor output, therefore, varies in accordance with the displacement of the movable element of the sensor (conductor 2 in FIG. 1) relative to the fixed element (conductor 4 in FIG. 1) as described by equation 19. Examination of equations 17 and 18 reveals the following:

(1) The maximum sensitivity of the sensor is attained when the permittivity of the dielectric $\epsilon_2$ is near unity (air).

(2) The permittivity of the dielectric $\epsilon_1$ bears on the sensitivity of the sensor from the viewpoint that the magnitude of the electric field discontinuity is affected by its value.

(3) The dimension of the inner conductor has no bearing on the electric field in the sensing element region. The interfacial charge is not, however, factored into this finding.

(4) Maximum sensitivity, in terms of displacement, occurs when the inner dimension of the outer conductor approaches the outer radius of the inner dielectric.

The residual charge of the dielectric factors heavily on the sensor sensitivity. The inner conductor 30 surface charge term $\rho_L$ is a measure of space charge developed from the residual charge. The process of the space charge development is identical to that of the parallel plate capacitor. In this case, the inner conductor is surrounded by an insulating dielectric and the second dielectric region is air ($\epsilon_2=1.0005$). Dielectric susceptibility $\chi$ is defined as $$\chi=\epsilon_{R-1} \tag{20}$$

The dielectric susceptibility of the Teflon is a factor of 2000 greater than the air, therefore, the primary space charge develops on the inner conductor interface polarizing the dielectric setting up the electric field that behaves in accordance with Equations 17 and 18. Why some materials possess more residual charge than others is not understood and, to date, has been determined empirically.

Figure 5A:
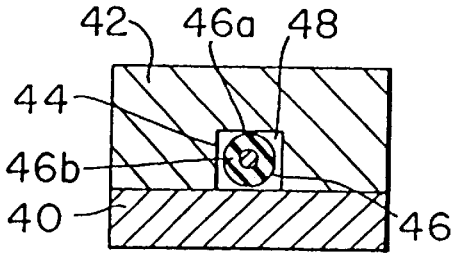
FIGS. 5*a*–5*i* are cross-sectional views of various sensor configurations.
Figure 5B:
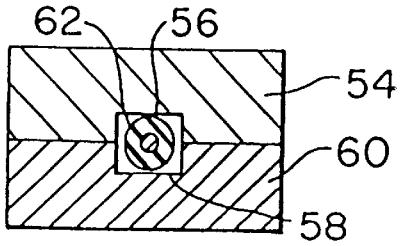

Referring now to FIGS. 5*a* and 5*b*, there are shown several possible configurations for the sensor of the present invention. The sensor shown in FIG. 5*a* includes a lower conductor member 40 and an upper conductor member 42, the upper conductor member containing a channel 44 defining a cavity having a generally square cross-section. An elongated wire 46 having a circular cross-section is contained within the channel 44, thereby defining an air gap 48 within the channel around the wire. Wire 46 includes an inner conductor 46*a* and an insulating covering 46*b* and may be, for example, a standard insulated wire.

The sensor shown in FIG. 5*b* is similar to the one in FIG. 5*a* except upper conductor member 54 contains channel 56 having a generally rectangular cross section which is aligned with a channel 58 contained in lower conductor member 60 having a generally rectangular cross-section, thereby defining a channel having a square cross-section which receives wire 62.

Figure 5C:
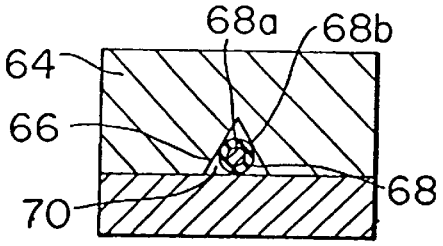

The sensor shown in FIG. 5*c* is similar to the one shown in FIG. 5*a* except upper conductor member 64 contains a channel 66 having a triangular cross-section. A wire 68 having an inner conductor 68*a* and an insulating covering 68*b* is contained within the channel, thereby defining an air gap 70.

Figure 5D:
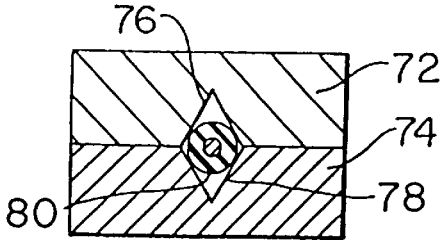

The sensor shown in FIG. 5*d* is similar to the one shown in FIG. 5*c* except upper conductor member 72 and lower conductor member 74 each contain channels 76, 78 respectively, which define a diamond shaped channel for containing a wire 80.

Figure 5E:
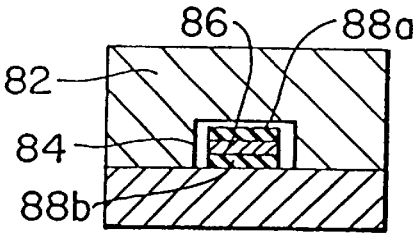
Figure 5F:
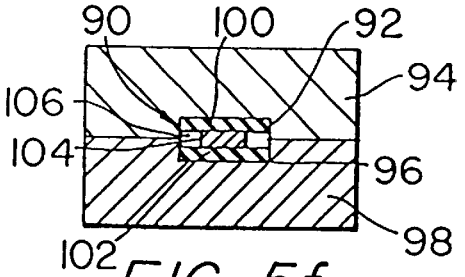

The sensor shown in FIG. 5*e* includes an upper conductor member 82 which contains a channel 84 having a rectangular cross-section and a conductor strip 86 having an insulating covering 88*a* and 88*b*. The sensor shown in FIG. 5*f* includes a channel 90 which is defined by a groove 92 contained in the upper conductor member 94 and a groove 96 contained in lower conductor member 98. An upper insulating member 100 and a lower insulating member 102 are contained within channel 90 and surround a conductive strip 104 and define an air gap 106 therebetween.

Figure 5G:
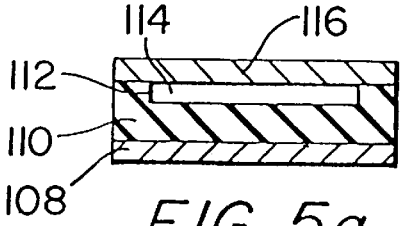
Figure 5H:
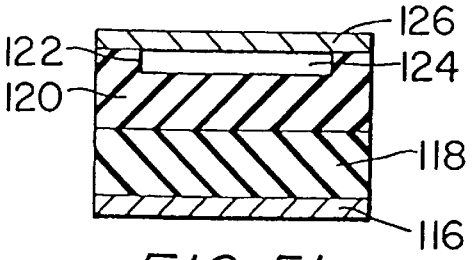

The sensor shown in FIG. 5*g* includes a lower conductive member 108, an insulating member 110 having a channel 112 defining an air gap 114, and an upper conductive member. The sensor shown in FIG. 5*h* includes a lower conductor member 116, a lower insulating member 118, an upper insulating member 120 containing a channel 122 which defines an air gap 124, and an upper conductor member 126.

Figure 5I:
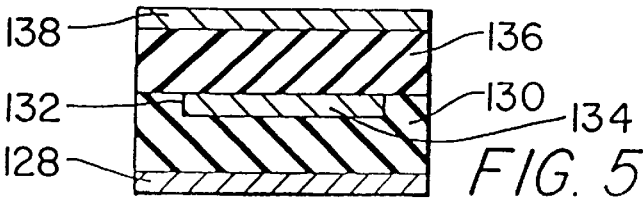

The sensor shown in FIG. 5*i* includes an elongated lower conductor plate 128, an elongated lower insulating member 130, an elongated bonded conductive strip 134 adjacent the lower insulating member 130, an elongated upper insulating 136 member, and an elongated upper conductor member 138 arranged generally parallel with lower conductor member 128. The parallel conductive plates 128 and 138 produce a linear response with regard to vertical motion of the electrode which allows this sensor configuration to also be used to measure weight.

Figure 6:
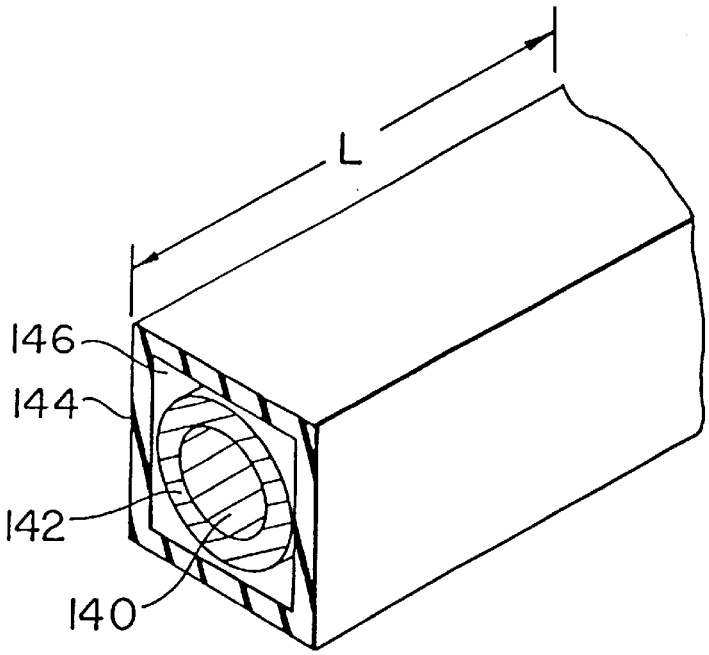
FIG. 6 is a partial sectional perspective view of a single lane coaxial sensor.

FIG. 6 shows a partially sectioned perspective view of a sensor which includes an elongated cylindrical inner conductor 140 which may be a copper wire, a first dielectric 142 on the outside of the inner conductor which may be insulation on the wire, paper, or KYNAR metalized on one side, and an elongated square-shaped outer conductor member 144 which may be a conductive rubber material. The inner conductor 140 and dielectric 142 are in intimate contact. An air gap 146 extends from the outer periphery of the first dielectric to the inner periphery of the outer conductor member and serves as a second dielectric. The length L of the sensor may be 100 feet or more.

Figure 7:
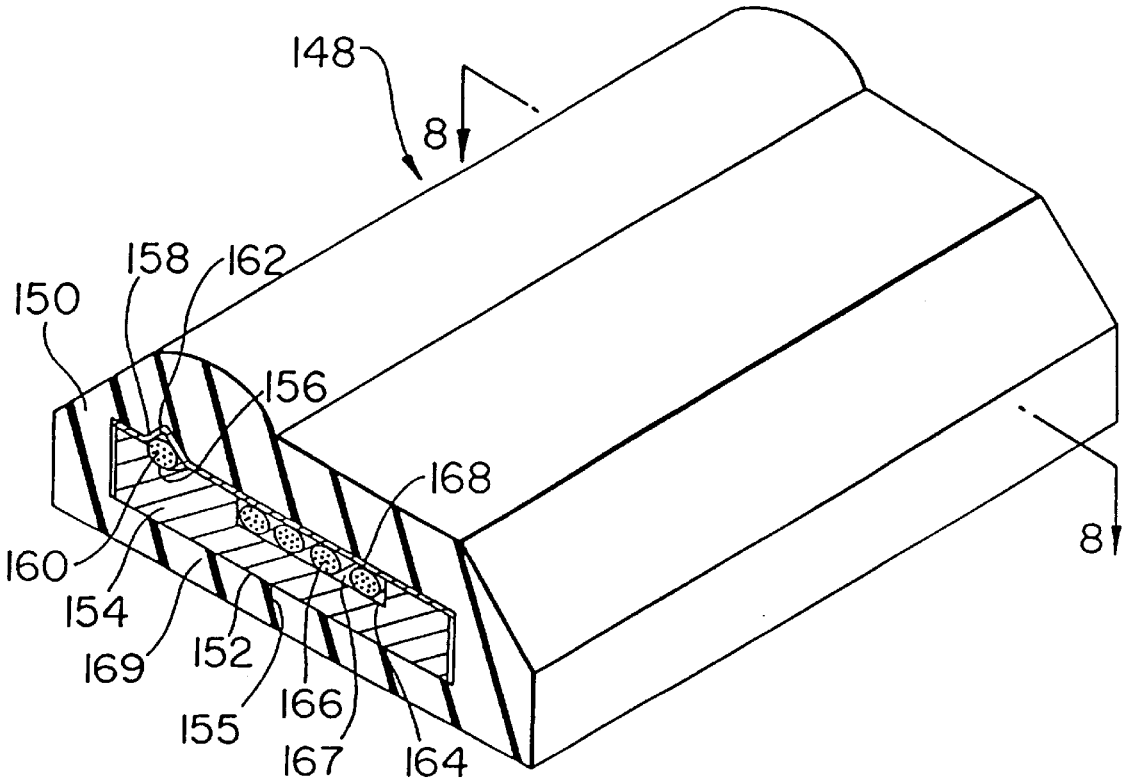
FIG. 7 is a partial sectional perspective view of a multiple lane sensor.

A sensor for monitoring multiple lanes of traffic is shown in FIG. 7. The sensor 148 includes an elongated housing 150 which is formed of, for example, a conductive elastomeric material, and contains an elongated cavity 152 which is adapted to receive a mounting bar 154. A slit 155 is provided in the bottom of the housing to allow access to the cavity and the components contained therein. The housing 150 is formed of a conductive elastomeric material and is designed to lie on the roadway surface and is fixed thereto using appropriate hold-down devices (not shown). The housing protects the internal circuitry of the sensor from the ambient environment and also, owing to its conductive property, acts as a movable electrode which generates an electric signal when stuck by the tire of a vehicle traversing the sensor.

The upper surface of the mounting bar contains a semi-circular channel 156 which is aligned with a V-shaped groove 158 contained in the upper surface of the cavity 152. Channel 156 and groove 158 cooperate to form an elongated channel adapted to receive sensor wire 160. Sensor wire 160 is a length of #16 gauge stranded Teflon insulated wire formed of a stranded wire surrounded by Teflon insulation. The sensor wire is surrounded by an air gap 162 which acts as a second dielectric.

Mounting bar 154 further contains a second channel 164 which receives a transmission cable 166 such as a conventional ribbon cable. In order to minimize unwanted signals generated in the ribbon cable, the cable is covered with copper tape 168. The copper tape serves to contain the fields generated by the ribbon cable wires and further serves to separate the ribbon cable from the elastomeric housing 150. Ribbon cable 166 is affixed to the mounting bar 154 in channel 164 with an adhesive film tape 167 which serves to minimize vibration of the ribbon cable upon tire impact. A second adhesive film 169 serves to secure the mounting bar 154 within the housing 150 after the sensor components have been installed in the housing, thereby protecting the components from the punishment they will absorb from the traffic. The second adhesive film also serves to seal the components contained in cavity 152 from the environment.

The overall length of the sensor 148 is dependent on the number of lanes to be monitored, each lane typically requiring a sensor having a length of 10 to 12 feet. It will be recognized that the length of the sensor elements, the number of sensor elements, and the number of signal carrying wires included in the ribbon cable may be varied to suit particular installations.

The multi-lane sensor contains multiple sensor elements and a cable for transmitting the sensed signal to host recording equipment. Transmitting the signal to the recording equipment must be accomplished without corrupting the signal with distortion or cross-talk from the other sensors or cross-talk generated within the transmission cable. Signal distortion is caused by parasitic capacitance within the sensors themselves and from the transmission cable. The internal impedance of the sensor has been measured to be greater than five megohms. If the recording device has a high impedance, considerable distortion of the sensor output signal can be present but high impedance devices employed are routinely used to develop measurable signal levels. A transimpedance amplifier can be employed to avoid this difficulty.

Adequate isolation must be provided in the transmission cable to reduce the cross-talk to a sufficiently low level to ensure adequate signal-to-noise ratios. Perhaps the most significant problem to overcome is preventing the transmission cable from becoming a sensor itself. The same elements required in the sensor are used in the transmission cable. Without proper attention to the design, the transmission cable can generate substantial signal levels. The spurious signals mix with the genuine output of the individual lane sensors, thereby introducing error in the count. To ensure the integrity of the recorded date, greater than 26 dB of isolation must be achieved between sensor channels. Measured performance of the configuration defined herein is greater than 40 dB.

Figure 8:
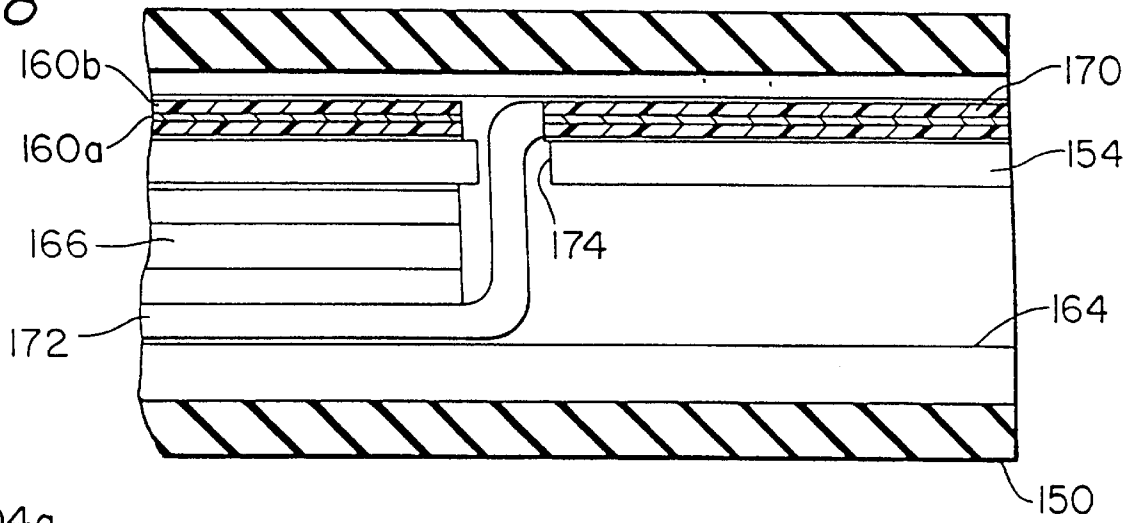
FIG. 8 is a sectional view taken along line 8—8 of FIG. 7.

FIG. 8 shows the interconnection of a sensor wire 170 with the appropriate wire 172 of the ribbon cable 166. Since each sensor wire is designated to monitor traffic traveling within a single lane, the interconnection is placed at the interface of the lanes. The connection is achieved by routing wire 172 through a channel 174 contained in the mounting bar 154 and soldering the wire to the termination of the sensor wire 170. The termination of the sensor wire is merely the end portion of the wire with the insulation removed. Heat shrinkable insulation (not shown) is used to cover the connection to prevent contact with either the mounting bar or the housing.

Figure 9A:
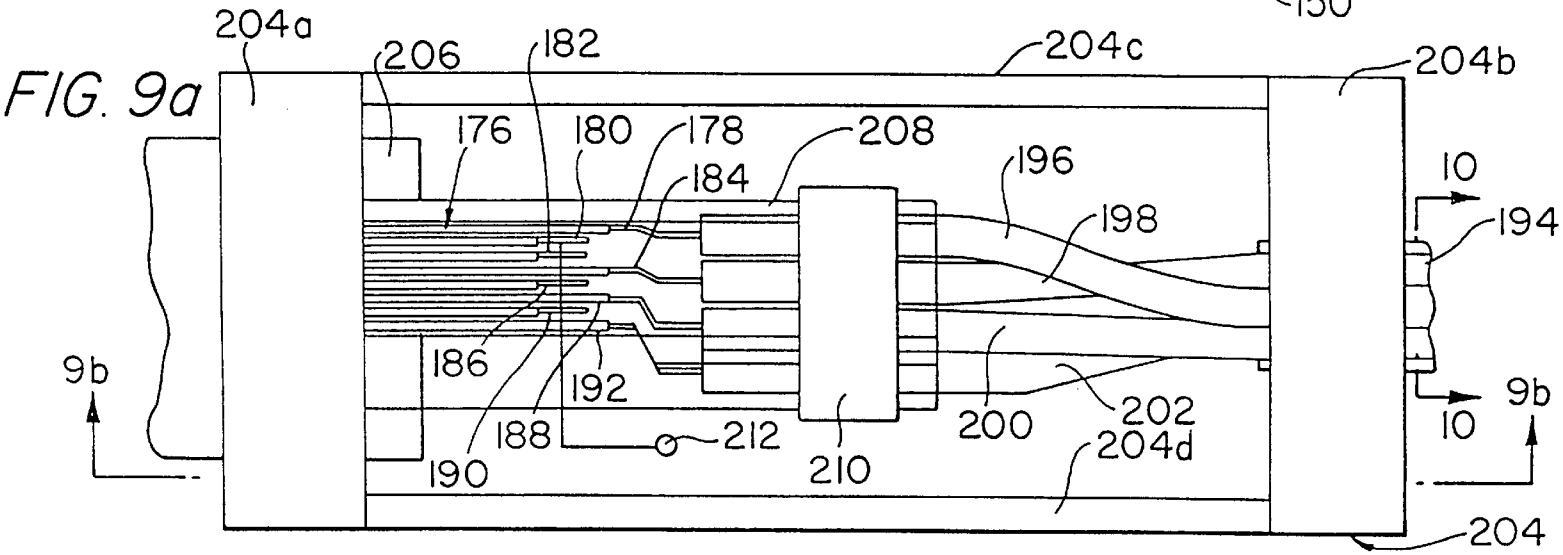
FIG. 9*a* is a top plan view of the connection between a ribbon cable and a pendant cable.
Figure 9B:
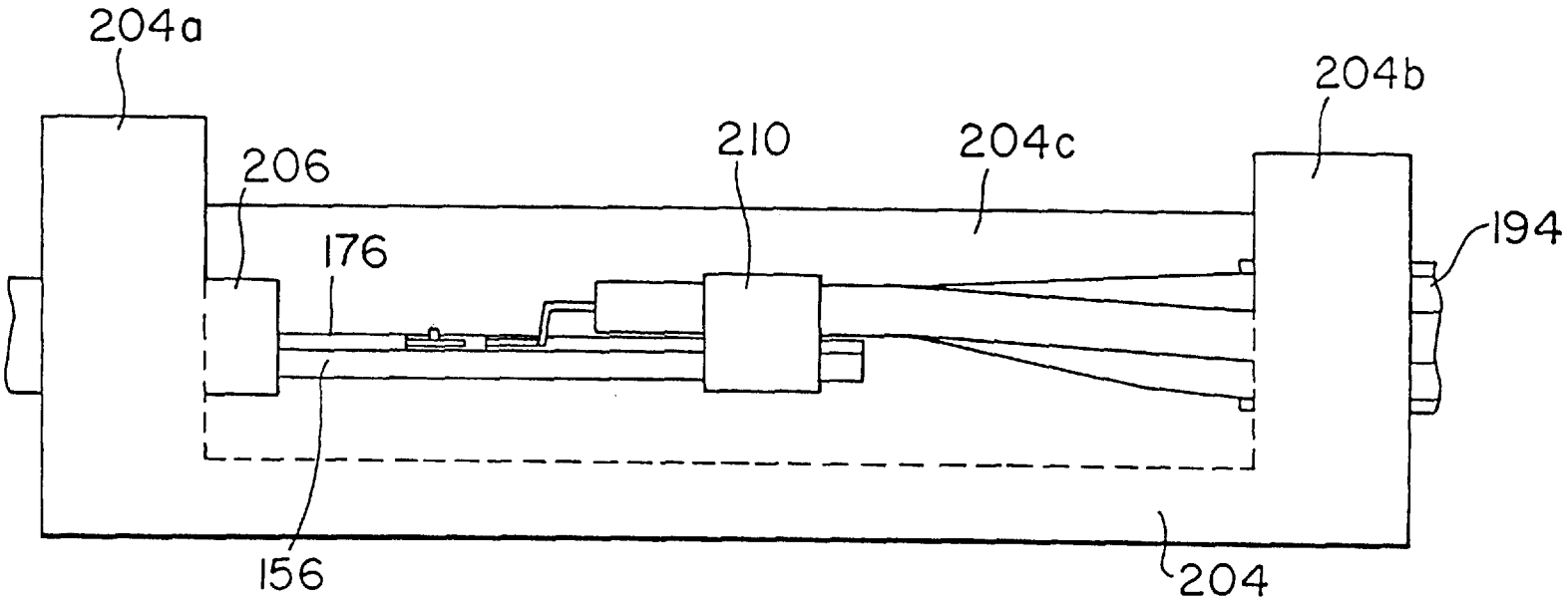
FIG. 9*b* is side plan view taken along line 9*b*—9*b* of FIG. 9*a;*
Figure 10:
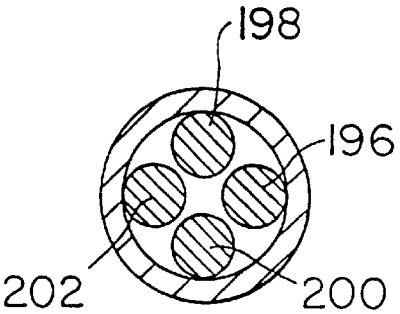
FIG. 10 is a sectional view taken along line 10—10 of FIG. 9*a*.

FIGS. 9*a* and 9*b* show the connection of a ribbon cable 176 consisting of eight insulated stranded transmission wires 178, 180, 182, 184, 186, 188, 190, and 192 with a bundled coaxial cable or pendant cable 194 consisting of four coaxial transmission lines 196, 198, 200, and 202 (FIG. 10). It will be recognized that the number of transmission lines depends on the number of lanes of traffic being monitored and may be increased or decreased accordingly.

An epoxy molded support member 204 having end walls 204*a* and 204*b* and side walls 204*c* and 204*d* provides the ribbon cable/pendant cable connection with the mechanical integrity needed for roadway application. The sensor housing 206 and mounting bar 208 are molded into side wall 204*a* and extend toward side wall 204*b*. Ribbon cable 176 is supported on the mounting bar 208. The pendant cable 194 passes through end wall 204*b* and the four transmission lines are spread to lie side-by-side on the mounting bar 208 and are clamped thereto with clamp 210. The other end of the pendant cable is connected with traffic analyzing, classifying, and recording equipment (not shown) via a moisture resistant multi-pin connector (not shown).

In the sensor configuration shown in FIGS. 9*a* and 9*b*, four lanes of traffic are monitored. Four transmission wires 178, 184, 188, and 192 of the ribbon cable therefore carry signals from four corresponding sensors and the remaining four transmission wires 180, 182, 186, and 190 carry no signal. The active or signal carrying transmission wires 178, 184, 188, and 192, are connected with coaxial transmission lines 196, 198, 200, and 202, respectively. The inactive transmission wires 180, 182, 186, and 190, which are shown shorter than the active transmission lines, are interconnected and grounded at 212, thereby to provide isolation between the transmission lines carrying sensed signals and maintain cross-talk at acceptable levels. In addition, the four transmission lines of the pendant cable 194 are tied together and grounded to the same contact as that of the ribbon cable connections.

Figure 11:
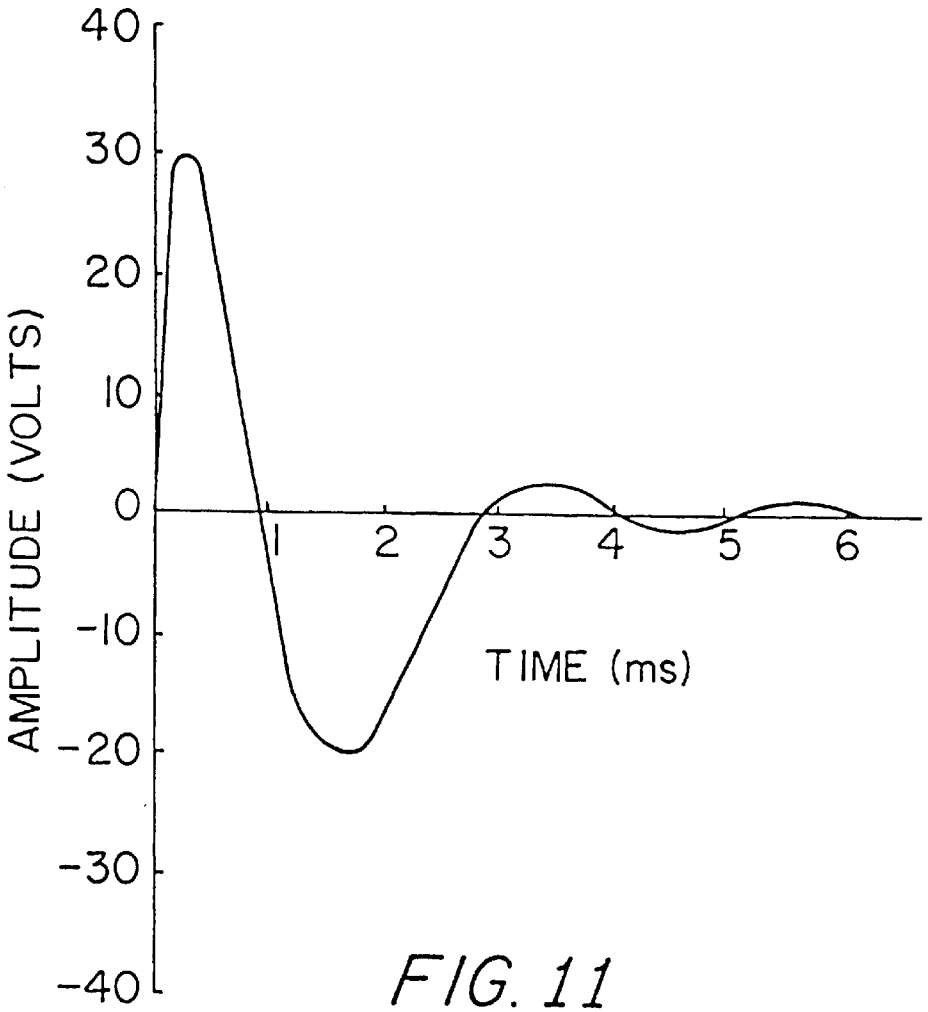
FIG. 11 is a graphical representation the typical signal output from a sensor.

FIG. 11 shows a typical output signal emerging from the sensor in response to excitation by a standard size car. The signal includes a positive portion reaching a maximum amplitude of approximately 30 volts which is followed by a negative portion reaching an amplitude of −20 volts. The negative signal results from the recovery of the elastomer to its initial condition. The amplitudes of the signal are a function of the weight and speed of the vehicle since both affect the displacement of the elastomer. The positive signal will likely be used as the signal for the measurement. The positive signal is used as the signal for measurement and analysis and the remainder of the signal is either ignored or filtered out. The positive signal ranges in amplitude from 10 to 120 volts depending on the weight and speed of the vehicle.

The sensor of the present invention reacts very quickly in comparison to the transition time of the measured event. Accordingly, the sensor of the present invention can be used to accurately measure the speed of vehicles traveling on the roadway by using two sensor strips with a known distance of separation. With the knowledge of speed, the recorded data can be analyzed to classify the vehicle.

While in accordance with the provisions of the Patent Statutes the preferred forms and embodiments of the invention have been illustrated and described, it will be apparent to those of ordinary skill in the art that various changes and modifications may be made

What is claimed is:

1. In a vehicle sensor adapted to be disposed on a roadway for monitoring traffic on at least one lane of the roadway comprising;

a housing comprising a first elongated conductive member (150) containing an elongated cavity (152) which is adapted to receive a mounting bar (154);

wherein said mounting bar contains a first channel (156) to receive a sensor wire (160) which comprises a second elongated conductive member (160) surrounded by a first elongated dielectric **(160*b*)**;

said vehicle sensor being characterized in that a second elongated dielectric (162) is provided within the cavity surrounding said sensor wire and at least one of said dielectrics **(160*b*, 162)** has a naturally occurring first residual charge adapted to gravitate toward an interface formed between a surface of one of the conductive members to thereby cause a static electric field to be generated, and at least one of said conductive members is disposed for movement in said electric field so as to cause a disturbance of said field and a signal pulse to be generated upon movement of said at least one of said conductive members in said static electric field.

2. A vehicle sensor according to claim 1, wherein said second conductive member (160) comprises a conductive element **(160*a*) disposed within a cavity (152) in said first conductive member (160) and a plurality of sensor wires are disposed along said cavity (152) for monitoring a plurality of traffic lanes of the roadway and further including a transmission cable (166)** connected to said sensor wires for carrying electric signals corresponding to signal pulse generated.

3. A vehicle sensor according to claim 2, wherein said transmission cable (166) is a ribbon cable having a plurality of wires, (172) each of said wires (172) adapted for connection to a separate sensor wire for transmission of electric signals for monitoring the plurality of traffic lanes of the roadway.

4. A vehicle sensor according to claim 3, including a mounting bar (154) contained in a second elongated channel (164) adapted to receive said transmission cable.

5. A vehicle sensor according to claim 3, further characterized in that a conductive strip (168) is disposed between said transmission cable (166) and said housing (150) for isolation of signals generated by the transmission cable.

6. A vehicle sensor according to claim 3, further including a layer of adhesive (167) arranged between said conductive element (154) and said transmission cable (166) for minimizing vibration of said transmission cable upon impact by a vehicle tire.

7. A vehicle sensor according to claim 3, further characterized in that said housing (150) includes an access opening (155) affording access to said housing cavity.

8. A vehicle sensor according to claim 2, wherein said transmission cable (166) is a ribbon cable having a plurality of wires (172) said plurality of wires including active wires (178, 184, 188 and 192) for carrying electric signals from the sensor wires and isolation wires (180, 182, 186 and 190) which are grounded for minimizing cross talk between the active wires.

9. A vehicle sensor according to claim 2, further including a bundled coaxial cable (194), said bundled coaxial cable being connected to active wires of the sensor wires.

10. A vehicle sensor according to claim 1, wherein the first elongated conductive member and first elongated dielectric correspond, respectively, to a conductive central wire (160) and a dielectric covering **(160*b*)** on said wire.

11. A vehicle sensor according to claim 1, wherein said first dielectric is a polymer.

12. An impact sensing element according to claim 1, wherein said first dielectric is teflon.

13. A vehicle sensor according to claim 1, further characterized in that said housing (150) contains an elongated channel (156) adjacent said cavity (152), said elongated channel (156) being shaped to receive at least a portion of the sensing element, and further characterized in that air (162) is present in said housing channel, the air serving as the second dielectric of the sensing element.

* * * * *